US005248039A

United States Patent [19]

Nordlund

[11] Patent Number: 5,248,039

[45] Date of Patent: Sep. 28, 1993

[54] PACKAGE BLANK AND METHOD FOR PRODUCING A PACKAGE

[75] Inventor: Kai Nordlund, Tampere, Finland

[73] Assignee: Devipack Oy, Tampere, Finland

[21] Appl. No.: 768,864

[22] PCT Filed: Jan. 23, 1991

[86] PCT No.: PCT/FI91/00022

§ 371 Date: Sep. 27, 1991

§ 102(e) Date: Sep. 27, 1991

[87] PCT Pub. No.: WO91/11373

PCT Pub. Date: Aug. 8, 1991

[30] Foreign Application Priority Data

Jan. 26, 1990 [FI] Finland ..... 900426

[51] Int. Cl.[5] ..... B65D 25/14

[52] U.S. Cl. ..... 206/524.8; 156/276; 220/422; 493/100

[58] Field of Search ..... 156/62.2, 62.4, 85, 156/276, 283; 206/521, 524, 524.8, 584; 220/418, 420, 421-424, 429; 493/89, 93, 100, 101, 217

[56] References Cited

U.S. PATENT DOCUMENTS 3,462,007 8/1969 Heider et al. ..... 156/276
3,762,404 10/1973 Sakita ..... 206/524.8
4,193,499 3/1980 Lookholder ..... 206/524
4,411,364 10/1983 Friedman ..... 206/524.8
4,669,632 6/1987 Kawasaki et al. ..... 220/423
4,880,119 11/1989 Simon ..... 206/584
5,009,318 4/1991 Leinoy ..... 206/524.8

FOREIGN PATENT DOCUMENTS 0036655 9/1981 European Pat. Off. ..... 206/524.8

*Primary Examiner*—Jimmy G. Foster
*Attorney, Agent, or Firm*—Pollock, Vande Sande & Priddy

[57] ABSTRACT

A package blank is provided including a wrapping material and a substantially deformable inner material. The wrapping material consists of a resilient film having a sealed inner space. The inner material consists of particles accommodated within the sealed inner space. At least one article is surrounded by the package blank. During a package forming process, pressure is reduced within the inner space and the article is surrounded by the blank. The pressure reduction causes the wrapping material to tightly encircle the article, the inner material to be stiffened, and the particles to be substantially immobilized relative to each other. A stiffening plate included on a surface of the wrapping material is adapted to receive a piercing device during the package forming process. The piercing device penetrates the wrapping material and the stiffening plate and establishes a communication between the sealed inner space and a vacuum creating mechanism. A sealing member closes the communication upon removal of the piercing device.

14 Claims, 4 Drawing Sheets

PACKAGE BLANK AND METHOD FOR PRODUCING A PACKAGE

FIELD OF THE INVENTION

The present invention relates to a package blank and to a method for producing a package.

BACKGROUND OF THE INVENTION

Package blanks of the type of the present invention comprises an assembly formed by a sealed and resilient film or a like serving as a surface material and by a substantially deformable inner material consisting of particles, the inner material being accommodated inside a space confined by the surface or wrapping material. The deformable inner material has a volume which is less than that of the space confined by the surface material. A package blank is accompanied by at least a single article to be packaged which is substantially enclosed by the package blank through the deformation of the package blank. In order to produce a package, pressure is reduced in the space defined by the surface material, resulting in the deformable inner material stiffening and/or its particles being substantially immobilized relative to each other. This is how to produce a package, wherein a package blank enclosing an article provides an essential protection therefor during the package handling.

A package blank as described above is disclosed in the publication GB-1 095 311. In a method described in the cited publication, a negative pressure is produced by using a connector formed in the surface material and connected to a vacuum-creating device. The cited method is unreliable and tedious and not applicable to modern mass-production industry.

SUMMARY OF THE INVENTION

An object of this invention is to introduce a package blank, which is first of all very simple to manufacture in mass production and which, on the other hand, is very well adaptable to a package-erecting stage, particularly when applying mass production for manufacturing packages comprising a package blank and at least a single article to be carried therein. In order to achieve this object, a package blank of the invention is primarily characterized in that a film or a like surface serving as a wrapping material is provided with a stiffening plate or a like element adapted to receive a piercing means. The piercing means is adapted to pierce the wrapping material forming film or the like during the course of pressure reduction. The stiffening plate or a like element provides communication between a wrapping material confined space and a vacuum-creating mechanism. A stiffening plate facilitates the penetration of the piercing means, such as an injection needle, into the underpressurized space so as not to form an unnecessarily large hole in the wrapping material since the stiffening plate prevents the movements of a piercing means relative to the package blank. In addition, the stiffening plate provides a good base for closing the hole formed by a piercing means by using, for example, an adhesive tape or the like after underpressurization is completed and a piercing means removed from the hole. A suitable mechanism can be used for effecting the removal of the piercing means and the sealing of the hole as a single operation in a manner that underpressurization is maintained in the wrapping material confined space for a certain period of time.

Another object of the invention is a method for producing such a package. According to the method, upon a package blank is laid at least one article which is substantially encircled with a package blank whose wrapping material confines a space having a reduced pressure. A method of the invention is primarily characterized in that a piercing means is inserted at the initial stage of depressurization through a stiffening plate or the like element fitted in the surface of a package-blank wrapping material into a communication with a wrapping material confined space. With the piercing means in communication with this space. The pressure reduction is effected in the space confined by the wrapping material.

During the course of removing the piercing means, a penetrating hole produced by the piercing means is closed by means of a sealing member.

A method as described above facilitates the application of a package blank of the invention particularly in mass-production techniques.

The invention relates also to a preferred method for manufacturing a package blank.

BRIEF DESCRIPTION OF THE DRAWINGS

A package blank and a method of the invention shall now be described in more detail with reference made to the exemplary embodiment shown in the accompanying drawings. In the drawings

DETAILED DESCRIPTION OF THE PREFERRED EMBODIMENT

Figure 1:
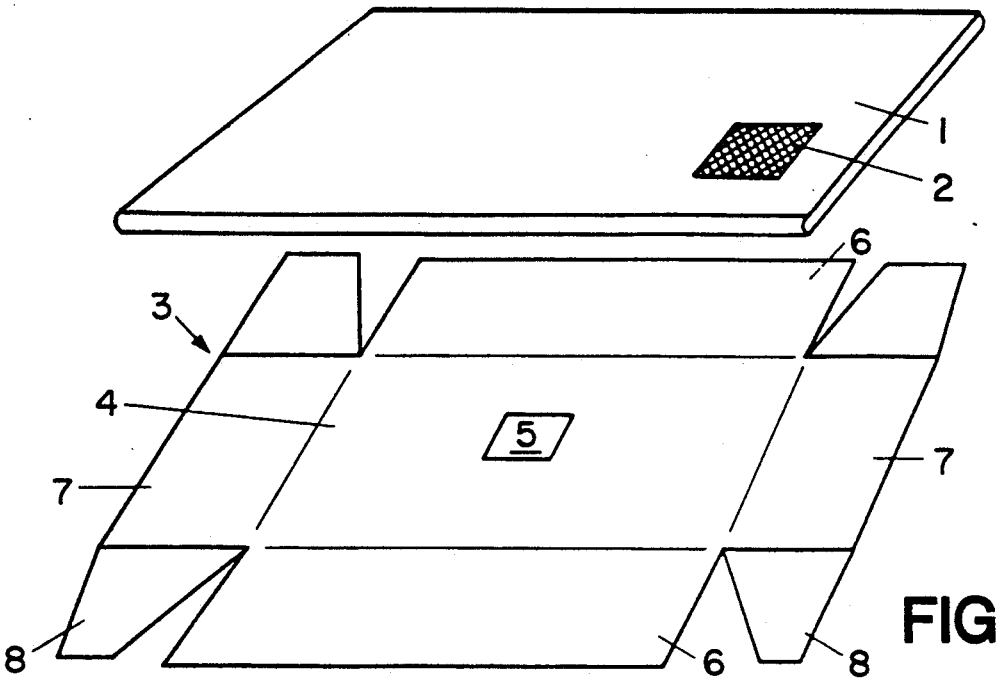
FIG. 1 shows one embodiment of a package blank of the invention in an exploded view.

Referring particularly to FIGS. 1 and 2, a package blank of the invention, which in configuration is, for example, a flat rectangular piece, comprises an assembly including a wrapping material 1, made of a sealed, airtight and resilient plastic film, and an inner material 2, which consists of particles and is substantially deformable.

In the present embodiment, a package blank 1, 2 is adapted to be laid on a base structure 3 which, in view of handling a package blank, preferably comprises a flat box layout, such as a cardboard, corrugated board or similar layout. Alternatively, the package blank may include a blank punched or cut out of a board-like material, which blank can be erected into a box for accommodating a package blank 1, 2 in its interior. The base structure 3 has a floor 4 provided with a flap 5 which is positioned in alignment with a stiffening plate of package blank 1, 2 whenever the package blank 1, 2 is laid upon base structure 3, as shown in FIG. 2, whereby the package blank 1, 2 is preferably fastened to the floor 4 of the base structure 3.

Figure 2A:
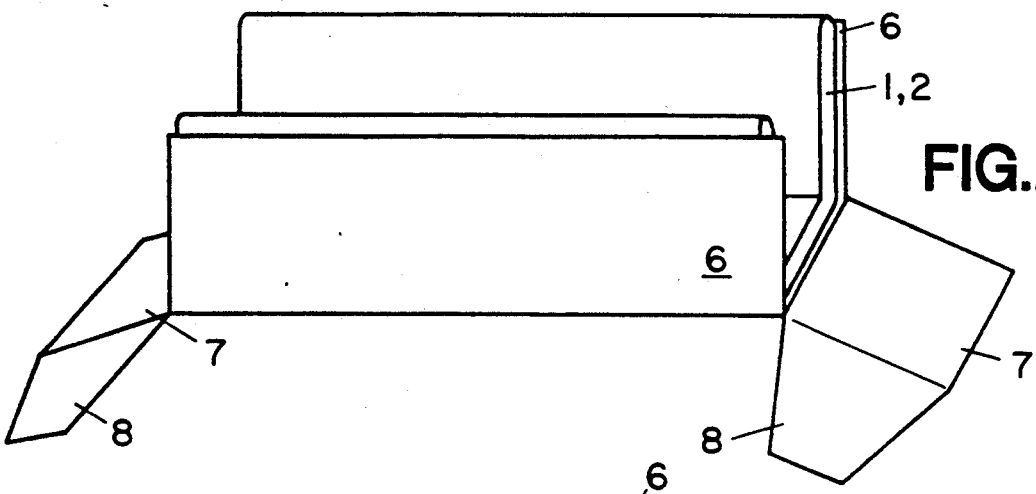
FIG. 2*a*–2*b* shows a package blank erected into a box structure.

Particularly as shown in FIG. 2*a*, as the side walls 6 of base structure 3 are folded to an upright position relative to the floor 4, the side portions of package blank 1, 2 comply with the folding action for providing the base structure with a space substantially confined by package blank 1, 2 for an article to be wrapped up. When the end panels 7 included in the base structure are folded to the an upright position relative to floor 4 and locked by means of flaps 8 in the position for fastening side walls 6 and end panels 7 to each other for a box-like configuration, the result will be a box or a case, shown in plan view in FIG. 2*b*. The case including package blank 1, 2 and base structure 3, is ready for article-packaging operations.

Figure 2B:
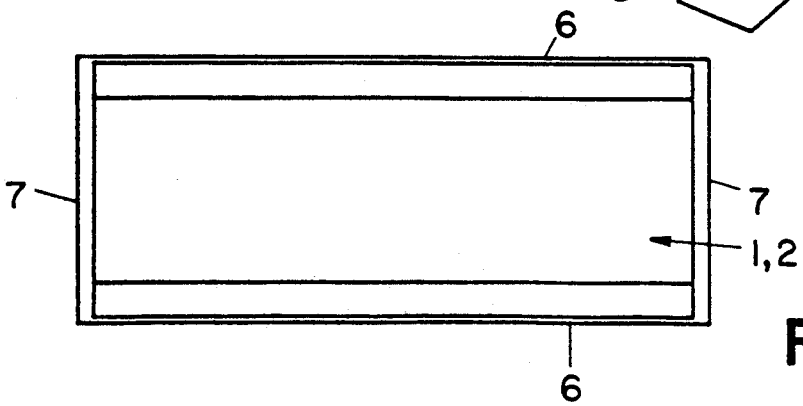
Figure 3A:
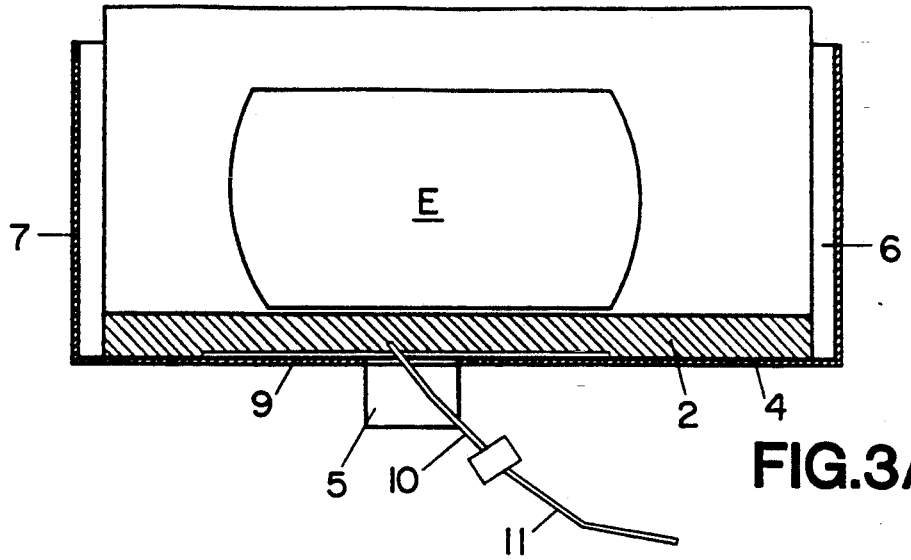
FIG. 3*a*–3*c* is a step-by-step view of applying a method of the invention when using the package blank of FIGS. 1 and 2.
Figure 3B:
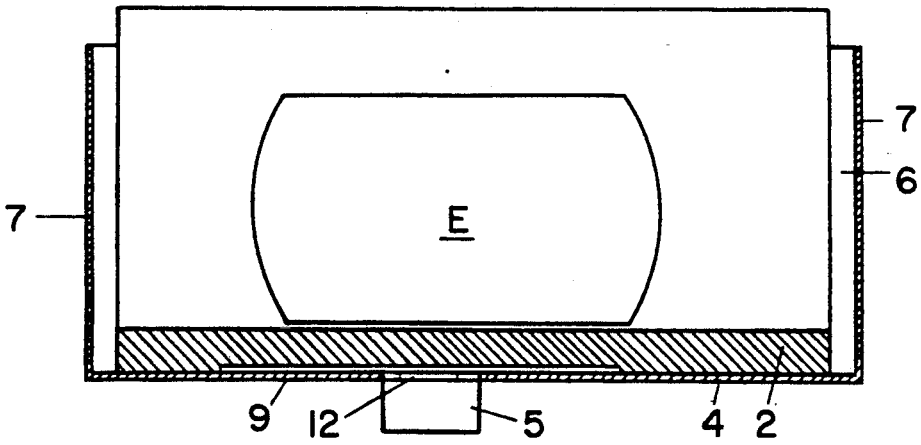

FIGS. 3*a* and 3*b* show a partial cross-sectional view, illustrating particularly the disposition of an article E inside the assembly of FIG. 2*b* so as to reveal a stiffening plate 9 laid in connection with the surface of package blank 1, 2 preferably on the inward-facing surface of a wrapping material, the plate being aligned with flap 5. Flap 5 is opened and a piercing means 10 such as an injection needle is inserted at the opening through stiffening plate 9 and wrapping material 1, into a communication with the inner material and, thus, with a space confined by wrapping material 1. The piercing means is used for effecting the depressurization of the space by operating a device, such as a vacuum pump (not shown), mounted at the end of a piercing means connecting tube 11.

Figure 3C:
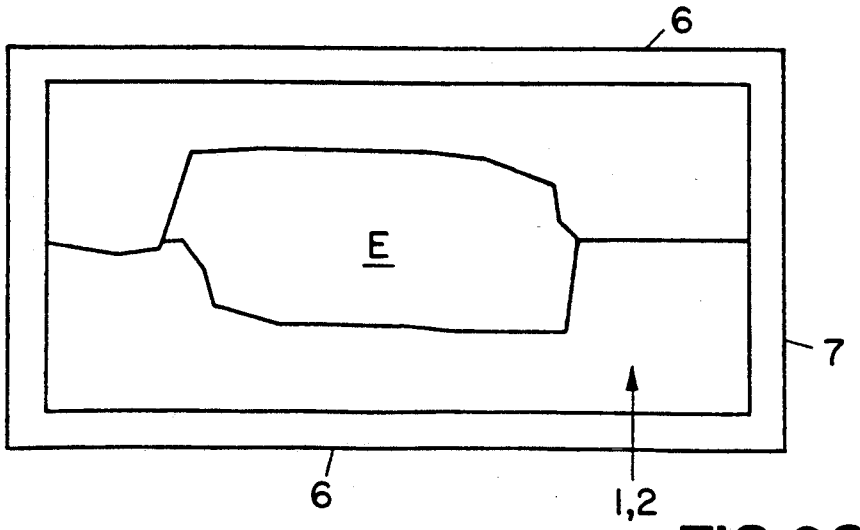

Following the stage shown in FIG. 3*a*, said piercing means 10 is withdrawn and, at the same time, a hole formed thereby is sealed with a sealing member, such as a piece of adhesive tape 12. Flap 5 is closed and, as shown in FIG. 3C a wrapped-up article E, and now squeezed and substantially enclosed by a depressurized package blank, can be carried over to the next operations.

The materials suitable for use as a wrapping material of package blank 1 include particularly gastight polyamide film laminates and in certain applications, also polyethylene films. Such applications include, for example, if a package blank 1, 2 protecting an article E only needs to stay firm for a limited period of time, such as from 2–3 days to 1–2 weeks. Packaging tests have been performed by using wrapping material films with thicknesses varying from 50 μm to 100 μm. Naturally, the thickness of a wrapping material has an effect on the strength, particularly the penetration resistance, of a package blank. Thus, the wrapping material can be completely airtight or, on the other hand, the wrapping material can be permeable to air so as to facilitate a controlled and desired disappearance of depressurization.

A plurality of different materials or combinations of such materials can be used as an inner material. One possibility is to use cellular polystyrene pellets, which, in principle, make a highly preferred material due to their lightness and readily achieved displacement, especially when placing article E in a package blank. Accordingly, as for foamed plastic materials, certain forms of polyurethane can of course be applicable. One particularly preferred group of inner materials comprises so-called recycled products, especially and essentially cellulose-based products, such as mashed paper, sawdust, shavings and similar by-products from industrial processes, offices and households. The sawdust which is particularly suitable for use as an inner material comprises finely powdered dry dust. The mashed paper suitable for use comprises, for example, paper chopped by means of a paper chopper into strips having a length of about 1–2 cm and a width of about 0.3 cm. The tests conducted with these materials and combinations thereof proved that a package blank became highly deformable at the packaging stage. In certain applications, it is preferable to admix in the inner material a certain amount of an adhesive for improving the coherence of an inner material without, however, impairing its deformability.

Figure 4A:
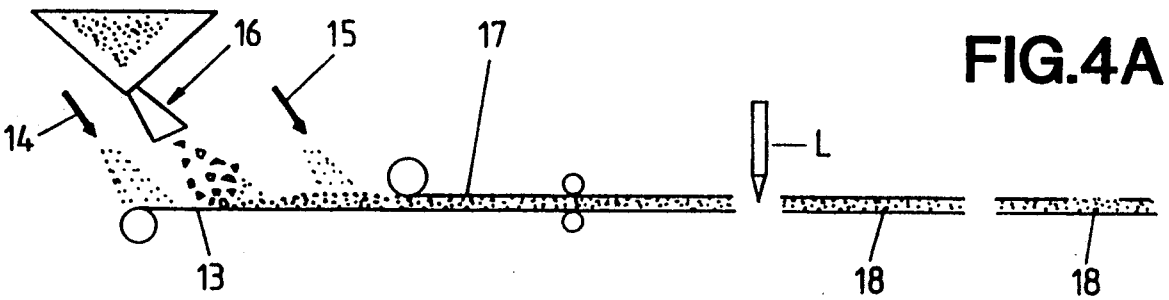
FIG. 4*a*–4*b* is a schematic view of a manufacturing method relating to one embodiment of a package blank.

Thus, a particularly useful approach is to apply the technique shown in FIG. 4. Its this technique, an inner material blank is manufactured in the first operating stage A using a continuous process. In this process, the lowest component in a production line is a porous surface web 13, for example, of paper, on top of which is laid, at successive stages, at least one adhesive layer, for example, in a spray form (arrows 14 and 15), serving as a binder. During the course of adhesive spraying, upon the surface web 13 is laid, at a single or a plurality of stages, preferably in a layerwise increasing fashion, the actual inner material 16, such as crushed paper, or particularly mashed paper as discussed above. After the layer of crushed paper has grown in the above manner to a desired thickness, on top of this layer is laid a second surface web 17, which is likewise made of a porous material, such as some appropriate paper. Laying down the second surface is followed by effecting the cutting L of a web manufactured as discussed above into inner material blanks 18.

Figure 4B:
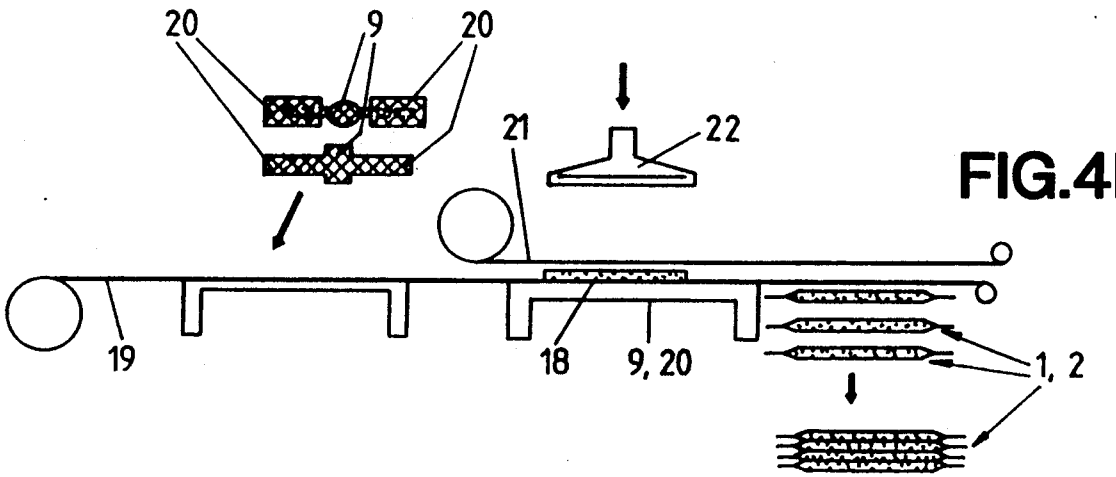

The manufacture of wrapping material 1 and a package blank itself is effected as shown in FIG. 4*b*. Thus, in a continuous process, the lowermost component on a production line will be a first half 19 on wrapping material. At the first stage, upon this wrapping material 19 is laid a stiffening plate 9, at a location for making a package blank. In the embodiment shown in FIG. 4*b*, the stiffening plate 9 further includes extensions 20 which extend in opposite directions from the edges of stiffening plate 9. These extensions 20 can be used for supporting an article to be packaged, for example, as sections placed alongside the article during the course of shaping a package blank. The sections reinforce the package and provide an extra protection for the article to be packaged. Sections or extensions 20 are especially employed in those applications in which a package blank is not placed inside a base structure 3 as shown in FIGS. 1–3, but, instead, an article is laid directly upon the package blank. At the next stage in a process, as shown in FIG. 4*b*, a second half or section 21 of wrapping material is laid on top of stiffening plate 9 and on top of a blank 18. The latter being placed on top of stiffening plate 9 at the stage preceding a seaming operation. A seaming device 22 is operated to effect the circumseaming of films 19 and 21 and the removal of finished package blanks from films 19 and 21. The stiffening plate is preferably adhered to film 19 for maintaining extensions 20 detached from wrapping material.

Suitable materials for use as stiffening plate 9 and extensions 20 include, for example, e.g. corrugated board, cardboard and plastic sheets.

Particularly after stage 4*b*, the finished package blanks can still be subjected to depressurization or alternatively the manufacturing operations shown in FIG. 4*b* can be carried out in a vacuum chamber. The space confined by the wrapping material of package blanks having therein a suitable preliminary vacuum, which facilitates the handling of package blanks during the packaging operation. A corresponding action can of course be achieved in the seaming and cutting operation by applying compression on the inner material during a seaming operation for removing as much air as possible from inside a package blank.

Figure 5:
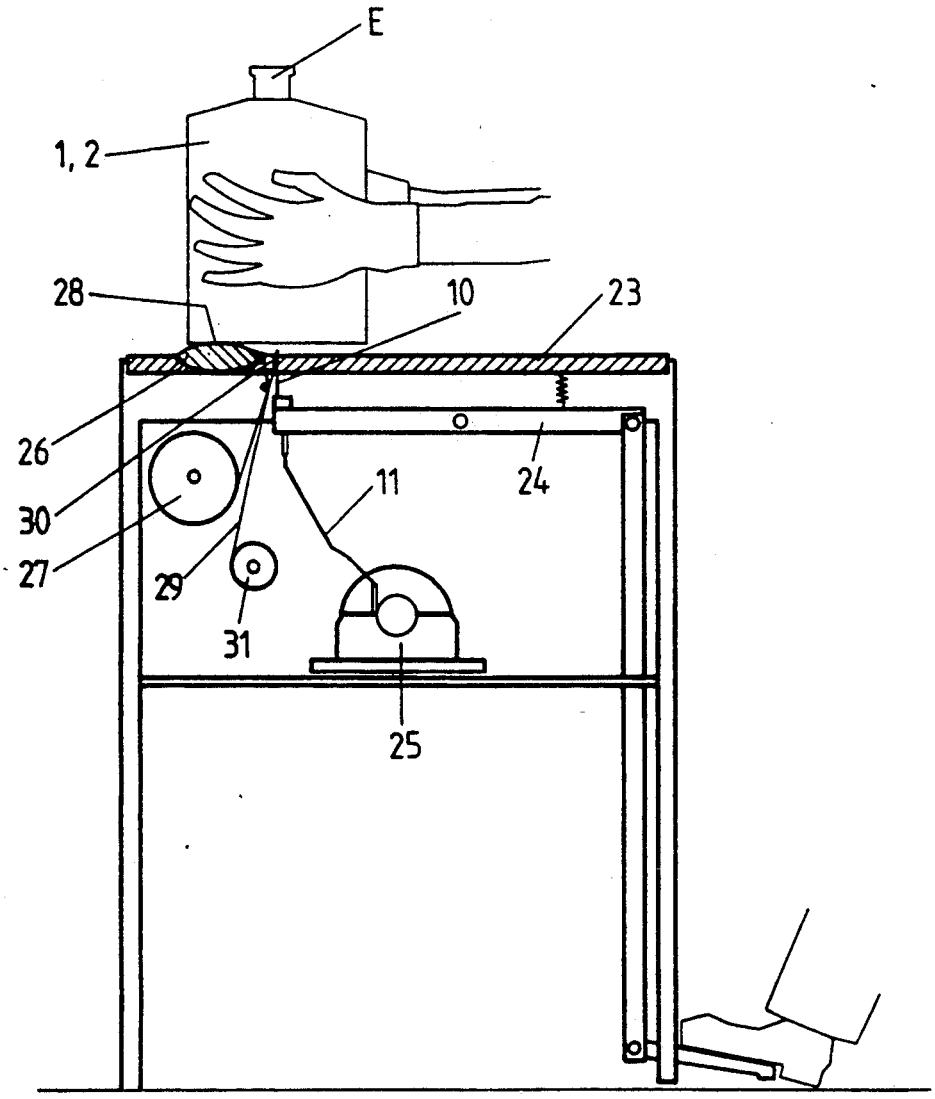
FIG. 5 is a schematic side view of an apparatus for carrying out the depressurization of a package blank and the sealing of a penetrating hole.

FIG. 5 illustrates one embodiment of an apparatus for manually effecting the creation of vacuum inside a package blank 1, 2 as well as the sealing of a piercing means inflicted hole effected after the removal of piercing means 10. Thus, the packager holds an article E and its surrounding package blank 1, 2 with both hands and places it on the top of a working table 23 at a location, wherein a piercing means can be pushed, for example, by means of a foot-operated mechanism 24 above the top of working table 23, through stiffening plate 9. Piercing means 10 is in communication by way of a connecting tube 11 or a like with a vacuum pump 25, which is set in operation, for example, by means of a foot switch. When a necessary vacuum has been created in the space confined by wrapping material 1 of package blank 1, 2, the mechanism 24 effects a spring-loaded return of piercing means 10 below the top of working table 23. A package blank is pushed to the left in FIG. 5 onto a pad 26, which carries an adhesive section 28 of a roll of adhesive tape 27 below the table, whereby the adhesive tape 28 sticks, by means of its adhesive surface, to wrapping material 1 at the hole of stiffening plate 9. A base tape 29 included in the roll of adhesive tape 27 is removed from adhesive tape 28 by means of a stripping device 30 and is returned onto a recovery roll 31 of base tape 29.

One benefit gained by a package blank of the invention can be said to be the fact that, if necessary, the same package blank can be re-used several times as a protective package for various articles, since a piercing means can be inserted several times through stiffening plate 9 by repeating the operations shown in FIG. 5.

Whenever a base structure 3 is not used in connection with a package blank 1, 2, it is possible, in the apparatus shown in FIG. 5, to locate a shaping means on the top of working table 23 at components 10 and 26. The package blank 1, 2 and an article E enclosed therein would be encircled by the shaping means during the package-forming operation.

I claim:

1. A package assembly comprising:

a package blank formed by a sealed and resilient film forming a wrapping member and by a substantially deformable inner material consisting of particles, said inner material being accommodated within a space defined by said sealed film, said inner material having a volume which is less than that of said space;

a stiffening plate provided in said package blank on a surface of said film during a package formation, said stiffening plate being adapted to receive a piercing means penetrating said film and said stiffening plate for establishing a communication means between said space and a vacuum creating mechanism, to create pressure reduction causing stiffening of said deformable inner material and substantial immobilization of said particles relative to each other resulting in deformation of said package blank to surround at least one article placed on said package blank, to be packaged, said stiffening plate being adapted to receive a sealing member to close said communication means upon removal of said piercing means; and wherein said package blank is laid upon an erectable base structure, said base structure being provided opposite said stiffening plate with a flap, whereby a piercing means is insertable inside said space confined by said wrapping material.

2. A package assembly according to claim 1, wherein a box forming a space for an article is formed from said base structure, and said package blank is in alignment with the floor and at least two opposite walls of said box.

3. A package assembly comprising:

a package blank formed by a wrapping material and a substantially deformable inner material, said wrapping material consisting of a resilient film, said film forming a sealed inner space, said inner material consisting of particles accommodated within said sealed inner space and having a volume less than said sealed inner space;

at least one article adapted to be placed on said package blank and to be substantially surrounded by said package blank during a process of forming said package assembly;

a stiffening plate provided on a surface of said wrapping material, said stiffening plate being adapted to receive a piercing means during said process of forming a package, said piercing means penetrating said wrapping material and said stiffening plate to establish a communication means between said sealed inner space and a vacuum creating mechanism, during said process of forming a package for causing a reduction of pressure within said sealed inner space, said reduction of pressure causing said wrapping material to tightly encircle said article, causing said inner material to be stiffened and causing said particles to be substantially immobilized relative to each other.

4. A package assembly according to claim 3, wherein said stiffening plate is placed on a surface of said film and fastened thereto, said surface facing toward an interior portion of said package after the formation of said package.

5. A package assembly according to claim 3, wherein said stiffening plate includes at least one extension, projecting from an edge thereof and adapted to be separated from said film.

6. A package assembly according to claim 3, wherein said inner material comprises granular and crushed material including at least one material selected from the group consisting of: cellular polystyrene, polyurethane grains, mashed plastics, mashed paper, shavings and sawdust.

7. A package assembly according to claim 3, wherein said film comprises a film laminate having a thickness of 50–100 μm and at least one layer consisting of a polyamide layer.

8. A package assembly according to claim 3, wherein said stiffening plate comprises a cellulose-based material including at least one material selected from the group consisting of: corrugated board and cardboard.

9. A package assembly according to claim 3, wherein said package blank is laid upon an erectable base structure, said base structure being provided opposite said stiffening plate with a flap.

10. A method for producing a package from a package blank, said package blank including a wrapping material and a substantially deformable inner material, said wrapping material consisting of a resilient film, said film forming a sealed inner space, said inner material consisting of particles accommodated within said sealed inner space and having a volume less than said sealed inner space, and a stiffening plate included on a surface of said wrapping material, said method comprising:

a) placing at least one article within said package blank;

b) inserting a piercing means thereby creating a penetrating hole through said stiffening plate establishing a communication means between said sealed inner space and a vacuum creating mechanism;

c) effecting a pressure reduction in said sealed inner space by said vacuum creating mechanism, said pressure reduction resulting in the stiffening of said inner material and substantial immobilization of said particles relative to each other; and d) closing said communication means by means of a sealing member during the course of removing said piercing means.

11. A method according to claim 10, wherein said inner material blank is prepared by depositing on said first continuous web a composition consisting of a binder and said inner material.

12. A method according to claim 10, wherein at least said sealing of said stiffening plate and said inner material blank within said film is effected in a depressurized space.

13. A method according to claim 10, wherein at least said sealing of said stiffening plate and said inner material blank within said film is effected by applying to said inner material blank a compressive force for reducing its volume.

14. A method for manufacturing a package assembly, said package assembly comprising a blank assembly including a sealed and resilient film serving as wrapping material and a substantially deformable inner material consisting of particles, said method comprising:

a) preparing an inner material blank by laying said inner material upon a first continuous web of material and covering said first continuous web of material and said inner material with a continuous second web of material, both said first and second webs being made of a porous material;

b) laying a stiffening plate upon a continuous web of said film, said film forming said wrapping material;

c) laying said inner material blank in alignment with said stiffening plate; and d) encircling by and sealing within said film an assembly formed by said stiffening plate and said inner material blank.

* * * * *